US007392000B2

(12) United States Patent
Choi

(10) Patent No.: US 7,392,000 B2
(45) Date of Patent: Jun. 24, 2008

(54) IMAGE FORMING APPARATUS TO CONTROL A LINEAR VELOCITY RATIO

(75) Inventor: Jeong-jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 344 days.

(21) Appl. No.: 10/843,427

(22) Filed: May 12, 2004

(65) Prior Publication Data

US 2005/0078982 A1 Apr. 14, 2005

(30) Foreign Application Priority Data

Oct. 13, 2003 (KR) ..... 10-2003-0070963

(51) Int. Cl.
*G03G 15/08* (2006.01)

(52) U.S. Cl. ..... 399/267; 399/274

(58) Field of Classification Search ..... 399/265, 399/267, 274, 275, 279, 284
See application file for complete search history.

(56) References Cited

U.S. PATENT DOCUMENTS 4,231,320 A * 11/1980 Asanae et al. ..... 399/103
4,245,024 A * 1/1981 Yamashita et al. ..... 430/122
4,309,498 A * 1/1982 Yamashita et al. ..... 430/100
5,484,680 A * 1/1996 Goto et al. ..... 430/122
5,571,987 A * 11/1996 Goto et al. ..... 399/276
5,659,861 A * 8/1997 Yamashita et al. ..... 399/267
5,783,345 A * 7/1998 Yoshino et al. ..... 430/102
5,923,933 A * 7/1999 Anzai et al. ..... 399/269
6,696,213 B2 * 2/2004 Yamaguchi et al. ..... 430/122
6,816,696 B2 * 11/2004 Nishizawa et al. ..... 399/270

FOREIGN PATENT DOCUMENTS

JP 58205166 A * 11/1983
JP 01102588 A * 4/1989
JP 01221776 A * 9/1989
JP 07140730 A * 6/1995
JP 08248688 A * 9/1996
JP 08328387 A * 12/1996
JP 11-102115 4/1999

(Continued)

OTHER PUBLICATIONS

Korean Official Action issued on Jul. 26, 2005, for Korean Patent Application No.: 2003-70963 (listing 1 reference).

(Continued)

*Primary Examiner*—Robert Beatty
(74) *Attorney, Agent, or Firm*—Stanzione & Kim, LLP

(57) ABSTRACT

An image forming apparatus having a photoconductive drum to form an electrostatic latent image corresponding to a predetermined image by a laser beam scanned after being electrified to a predetermined electric potential, and a developing roller to rotate together with the photoconductive drum having a developing gap therebetween and to transfer a developer, which is a mixture of a toner and a carrier, to the photoconductive drum to form a toner image on the electrostatic latent image, wherein a linear velocity ratio of a linear velocity of the developing roller to a linear velocity of the photoconductive drum is provided at a predetermined ratio, which provides maximum quality of the toner image.

22 Claims, 3 Drawing Sheets

FOREIGN PATENT DOCUMENTS

| | | |
|---|---|---|
| JP | 2002-023483 | 1/2002 |
| JP | 2002-229339 | 8/2002 |
| JP | 2003-066714 | 3/2003 |
| KR | 10-227586 KRX | 11/1999 |
| KR | 2003-66972 A | 8/2003 |

OTHER PUBLICATIONS

Korean Office Action dated Jan. 4, 2006 issued in KR 2003-70963.

* cited by examiner

IMAGE FORMING APPARATUS TO CONTROL A LINEAR VELOCITY RATIO

CROSS-REFERENCE TO RELATED APPLICATIONS

This application claims the benefit of Korean Application No. 2003-70963, filed Oct. 13, 2003, in the Korean Intellectual Property Office, the disclosure of which is incorporated herein by reference.

BACKGROUND OF THE INVENTION

1. Field of the Invention

The present invention relates to an image forming apparatus to develop an image using a two-component developer, and particularly, to an image forming apparatus capable of controlling a linear velocity ratio of a photoconductive drum and a developing roller.

2. Description of the Related Art

A general image forming apparatus, such as electrophotographic laser printer, forms an electrostatic latent image on a photoconductive medium (drum) using an exposure optical system, forms a toner image by developing the electrostatic latent image with a developing apparatus, and fuses the toner image transferred onto a recording paper.

The developer used for the developing apparatus is divided into a one-component developer and a two-component developer. In a case of the one-component developer, the toner particles are electrified by friction among themselves or by friction with a proper electrification member.

The two-component developer is a mixture of magnetic carrier particles and synthetic resin nonmagnetic toner particles, being mixed in a proper ratio. The toner particles are electrified while being mixed with the carrier particles. Thus, the electrified toner particles are transferred to a developing roller together with the carrier, and then adhere to an electrostatic latent image area on a surface of the photoconductive medium to form the toner image.

Meanwhile, a developing method using the two-component developer has been developed. A developing apparatus using the two-component developer comprises a photoconductive drum, a developing roller (a magnet roller) which rotates while maintaining a predetermined developing gap with the photoconductive drum, a doctor blade for cutting the two-component developer attached to a surface of the developing roller in a certain thickness, and a mixer for mixing the two-component developer.

In the above structure, the mixing ratio of the toner to the carrier (T/C) in the two-component developer is less than 5%. That is, if a high-speed printing is performed in a higher T/C toner ratio than 5%, the toner particles scatters and become afloat inside of the image forming apparatus, and therefore, peripheral parts beomces contaminated.

If the T/C toner ratio is decreased, an image density is accordingly decreased. In order to compensate for this problem and to implement a desired image density, in general, the developing apparatus is designed such that a ratio of a linear velocity of the photoconductive drum to a linear velocity of the developing roller is not less than 1 to 2.5. That is, the linear velocity ratio of the developing roller to the photoconductive drum is increased so that the T/C toner ratio is controlled to remain low. Then, during the high-speed printing, the image density can be prevented from decreasing.

However, in the above developing system, if the linear velocity ratio of the developing roller to the photoconductive drum is increased to much, a back portion of the toner image can be torn off with respect to a rotating direction of the photoconductive drum at a certain-thickness font, which is so-called a 'brush mark'.

More specifically, as shown in FIG. 1, a toner T adhering to a carrier C, which is electrified to a '+' potential at the developing roller, is transferred to a toner image area 2*a* of the photoconductive drum 2, which is electrified to a '−' potential, to form the toner image. At this time, if a linear velocity of the developing roller 1 to the photoconductive drum 2 is increased, a '−' potential of a non-image area 2*b* of the photoconductive drum 2 is increased by a heat increase of the photoconductive drum 2. Furthermore, the '+' potential of the carrier C on the developing roller 1 increases. Accordingly, the carrier C on the developing roller 1 is pulled to the non-image area 2*b* of the photoconductive drum 2, which has an increased '−' potential. In this process, the carrier C is mashed and scattered about a back portion of the toner T attached to the image area 2*a* ('A' area in FIG. 1).

SUMMARY OF THE INVENTION

In order to overcome the above-mentioned and/or other problems, it is an aspect of the present general inventive concept to provide an improved electrophotographic laser printer capable of controlling a linear velocity ratio of a developing roller and a photoconductive drum to improve quality of a toner image.

The above-described and/or other aspects of the present general inventive concept can be achieved by providing an electrophotographic laser printer that can include a photoconductive drum to form an electrostatic latent image corresponding to a predetermined image by a laser beam scanned after being electrified to a predetermined electric potential, and a developing roller to rotate together with the photoconductive drum having a developing gap therebetween and to transfer a developer, which is a mixture of a toner and a carrier, to the photoconductive drum to form a toner image on the electrostatic latent image, wherein a linear velocity ratio S of a linear velocity Vm of the developing roller to a linear velocity Vo of the photoconductive drum is 1.70 to 1.75.

In an aspect of the general inventive concept, the developing gap can be 0.73 mm to 0.76 mm.

In another aspect of the general inventive concept, the electrophotographic laser printer may further include a mixer to mix the toner and the carrier into the developer, a blade to cut the developer transferred to the developing roller into a predetermined thickness and to be mounted at a predetermined distance from the developing roller. It is another aspect a gap between the blade and the developing roller is 0.75 mm to 0.80 mm.

In another aspect of the general inventive concept, a diameter of the photoconductive drum may not be more than 30 mm, and a diameter of the developing roller may not be more than 25 mm.

In another aspect of the general inventive concept, the developer which is a mixture of the carrier and the toner, may have a 5% to 8% mixing ratio of the toner with respect to the carrier.

In another aspect of the general inventive concept, the photoconductive drum and the developing roller can rotate in an opposite direction to each other.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
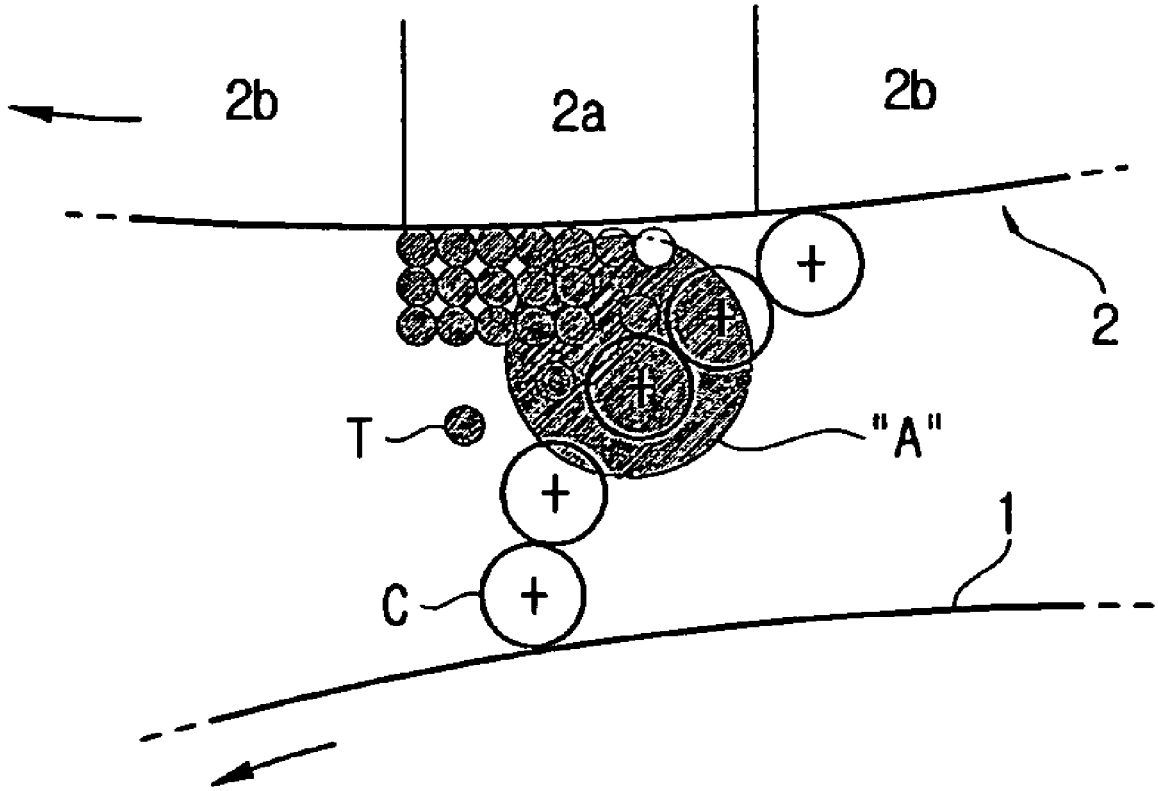
FIG. 1 (PRIOR ART)
FIG. 1 schematically shows a state that a toner image is damaged in a conventional electrophotographic printer.

Reference will now be made in detail to the embodiments of the present general inventive concept, examples of which are illustrated in the accompanying drawings, wherein like reference numerals refer to the like elements throughout. The embodiments are described below in order to explain the present invention by referring to the figures.

Figure 2:
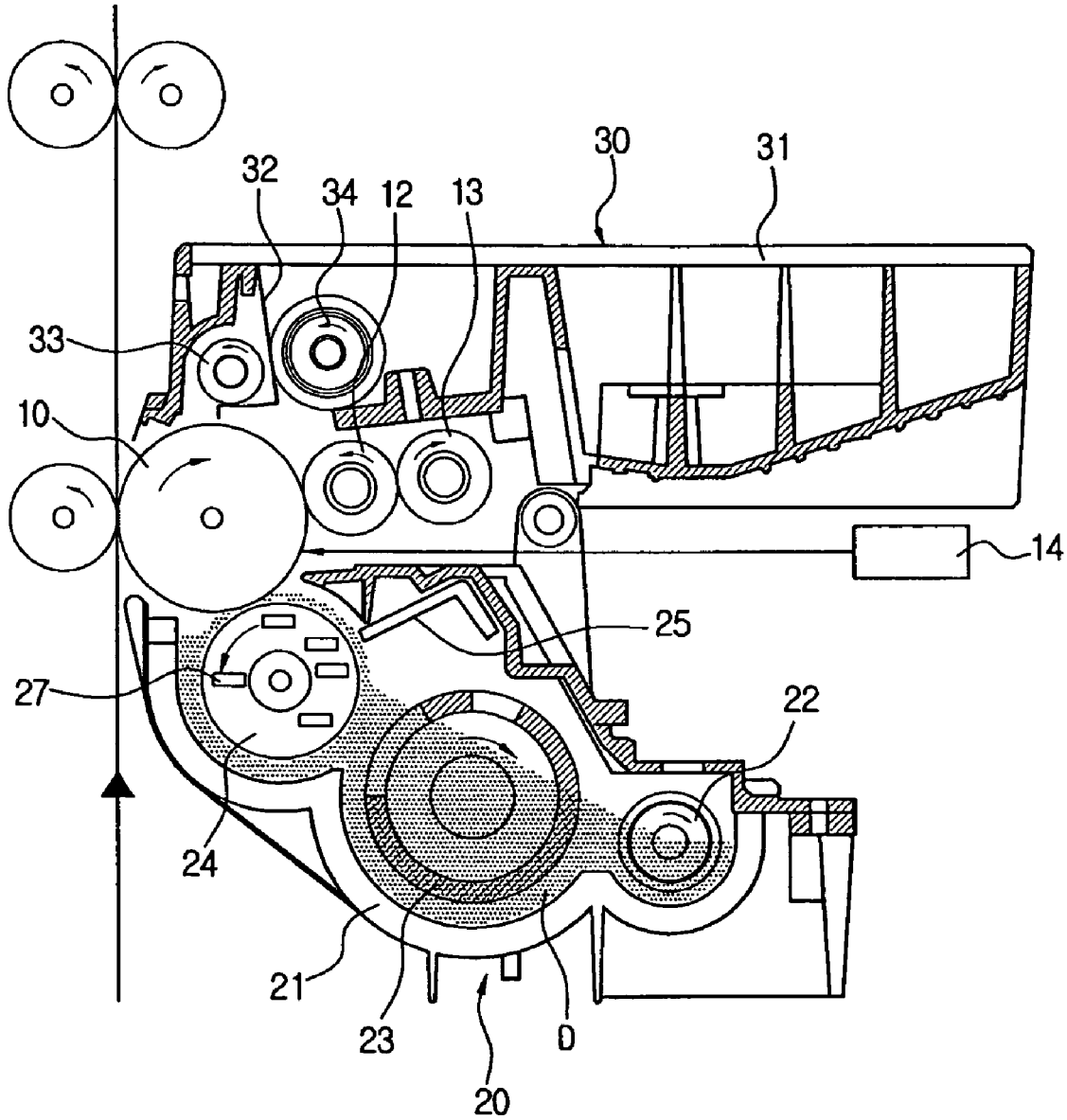
FIG. 2 is a schematic view showing an electrophotographic laser printer according to an embodiment of the present general inventive concept.

FIG. 2 is a schematic structure view explaining an image forming apparatus, such as an electrophotographic laser printer, according to an embodiment of the present, general inventive concept. In FIG. 2, a photoconductive drum 10 may be mounted as a photoconductive medium to rotate clockwise. An electrifying roller 12 and a cleaning roller 13 to clean the electrifying roller 12 can be mounted to rotate while contacting each other. A laser-scanning unit 14 can scan a laser beam on a surface of the photoconductive drum 10 electrified to a predetermined electric potential by the electrifying roller 12 and forms an electrostatic latent image.

At a lower part of the printer with respect to the photoconductive drum 10, a developing unit 20 can be provided to develop a two-component toner on the electrostatic latent image. At an upper part of the printer, a waste toner collecting unit 30 can be provided to remove and collect the toner remaining on the photoconductive drum 10. Here, the waste toner collecting unit 30 may include a waste toner cartridge 31, a cleaning blade 32, a collecting roller 33, and an auger 34. A structure of the waste toner collecting unit 30 is generally known, and therefore a detailed description thereof will be omitted.

The developing unit 20 may include a developing cartridge 21 to receive the two-component developer D, a supplying roller 22, a mixer 23, a developing roller 24, and a blade 25.

The two-component developer D can be made by mixing magnetic carrier particles and nonmagnetic toner particles in a predetermined mixing ratio. According to this embodiment of the present general inventive concept, a mixing ratio T/C of the toner T with respect to the carrier C may be 5% to 8%. Thus, if the ratio T/C of the toner T to the carrier C is controlled to be lowered, the toner can be prevented from scattering and becoming afloat in an inside of the printer even during a high-speed printing. In addition, according to a characteristic structure of this embodiment, a desired image density can be obtained even if the T/C ratio is lowered.

The developer D of the above mixing ratio can be supplied from the supplying roller 22 to the mixer 23. The mixer 23 can rotate to mix the toner T and the carrier C. In this process, the carrier C and the toner T can be electrified by a friction of the carrier C and the toner T For example, the carrier C can be electrified to a '+' potential, and the toner T can be electrified to a '−' potential. In an aspect of the general inventive concept, the carrier C and the toner T can be electrified alternatively, for example, by changing a material thereof. In this embodiment, the carrier C can be electrified to the '+' potential, and the toner T can be electrified to the '−' potential. Meanwhile, the toner T particles electrified to the '−' potential can adhere to a surface of the carrier C particles which are electrified to the '+' potential. Therefore, the developer D can maintain a regular mixing ratio. The mixed developer D can adhere to an outer circumference of the developing roller 24.

Figure 3:
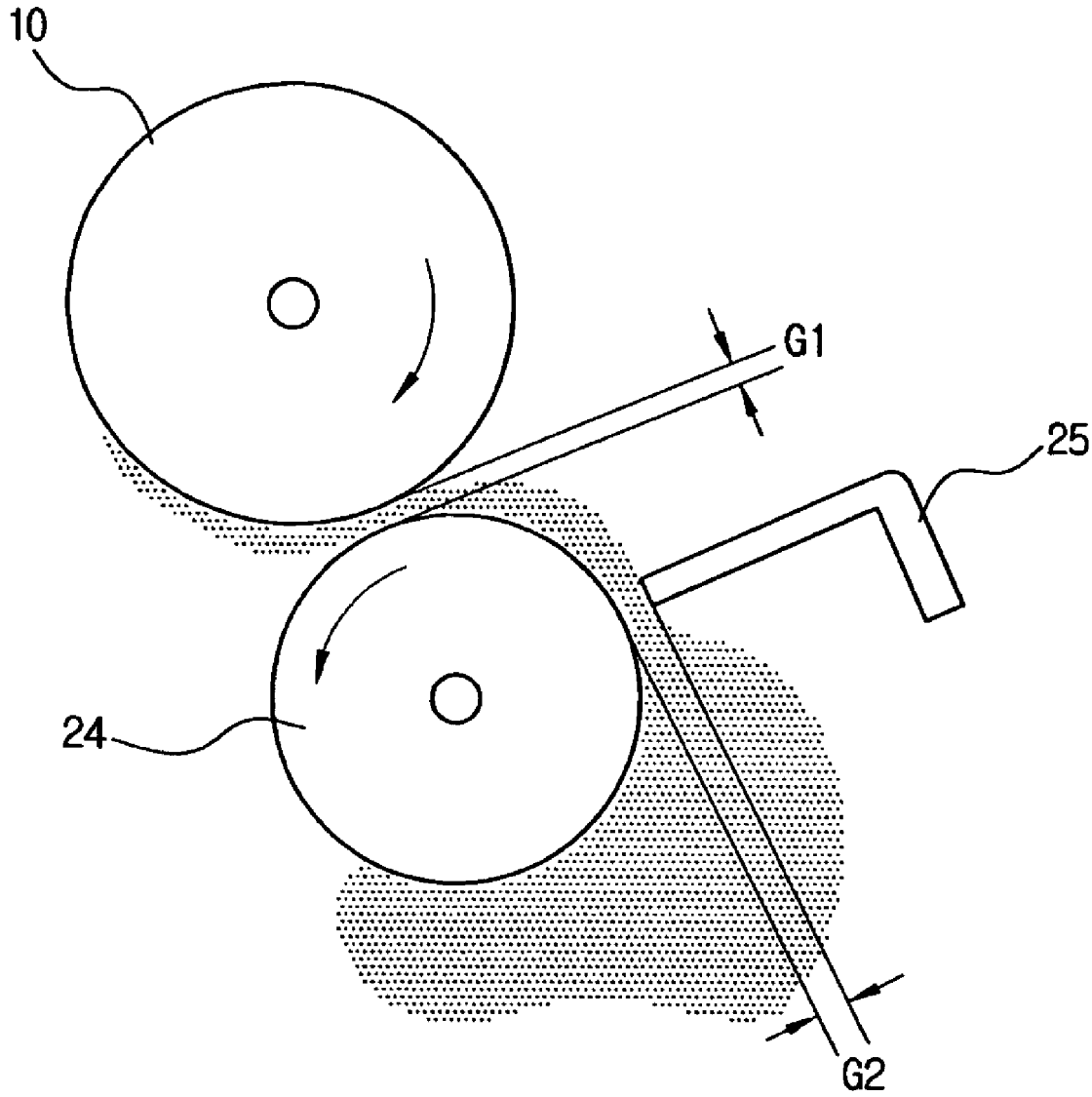
FIG. 3 is a view showing the main parts of FIG. 2.

The developing roller 24 may be a magnet roller including a magnet 27 therein, and made of an electrically conductive metal. The developing roller 24 can be directed toward the photoconductive drum 10 with a predetermined developing gap G1, as shown in FIG. 3, and can rotate in an opposite direction to the photoconductive drum 10, that is, counterclockwise. Accordingly, the developer D including the magnetic carrier C can adhere to the surface of the developing roller 24 by a magnetic force of the magnet 27. In an aspect of the general inventice concept, the developing roller 24 and the photoconductive drum 10 can be electrified to the '−' potential of a predetermined level.

The blade 25 can cut the developer D adhered to the developing roller 24 into a predetermined thickness. Therefore, the blade 25 can be mounted to have a predetermined gap G2, and the predetermined gap G2 can range from 0.75 mm to 0.80 mm. Accordingly, on a surface of the developing roller 25 that has passed the blade 25, the developer D-can adhere to the developing roller 25 to form a layer having a thickness of approximately 0.75 mm to 0.80 mm.

Additionally, the developing gap G1 between the developing roller 24 and the photoconductive drum 10 may be 0.73 mm to 0.76 mm. That is, the developing gap G1 can be smaller than the gap G2 such that the thickness of the cut developer D is larger than the developing gap G1 to enable a normal development.

Furthermore, in the above structure, the photoconductive drum 10 and the developing roller 24 may have small outer diameters as much as possible to realize a compact-sized developing unit 20 and a printer. It has been determined by experiments by the inventor herein that the photoconductive drum 10 should have an outer diameter of not more than 30 mm, and that the developing roller 24 should have an outer diameter of not more than 25 mm according to an embodiment of the general inventive concept.

In addition, in order to overcome a 'brush mark' which is a problem of a conventional printer, a photoconductive drum linear velocity Vo and a developing roller linear velocity Vm should have a ratio of 1:1.70~1.75. In other words, when the linear velocity ratio S, which is Vm/Vo, is 1.70/1 to 1.75/1, the 'brush mark' can be prevented and the desired image density can be obtained. Especially, in a case that an outer circumference of the photoconductive drum 10 is 30 mm, an outer circumference of the developing roller 24 is 25 mm, the developing gap G1 is 0.73 mm to 0.76 mm, and the gap G2 is 0.75 mm~0.80 mm, the best image quality can be obtained.

Table 1 below is a quality evaluation of the toner image which is developed on the photoconductive drum 10 according to the linear velocity S.

TABLE 1

| velocity ratio (Vo:Vm) | Image evaluation (brush mark) |
|---|---|
| 1:1.5 | X |
| 1:1.7 | □ |
| 1:1.75 | ○ |
| 1:1.9 | X |
| 1:2.0 | X |
| 1:2.25 | XX |

In the above Table 1, the image evaluation was accomplished by measuring an image area through an optical microscope.

O: The brush mark of the image is not found.

□: The brush mark of the image partially occurs.

X: The brush mark of the image apparently occurs.

According to the Table 1, when the velocity S is controlled to be 1.70 to 1.75, a high-quality image can be obtained without the brush mark occurred.

As described above, according to an embodiment of the electrophotographic laser printer, an image density deterioration and a brush mark appearance can be prevented by controlling a linear velocity ratio of a photoconductive drum and a developing roller to a predetermined value without increasing the ratio T/C.

Although a few embodiments of the present general inventive concept have been shown and described, it will be appreciated by those skilled in the art that changes may be made in these embodiments without departing from the principles and spirit of the invention, the scope of which is defined in the appended claims and their equivalents.

What is claimed is:

1. An image forming apparatus comprising:

a photoconductive drum to be formed with a latent image;

a developing roller to rotate together with the photoconductive drum with a developing gap therebetween and to transfer a developer which is a mixture of a toner and a carrier to the photoconductive drum to form a toner image on the latent image; and a mixer to mix the toner and the carrier into the developer, wherein:

the mixer rotates in a direction opposite to the developing roller, and a linear velocity ratio of a linear velocity of the developing roller to a linear velocity of the photoconductive drum is 1.70 to 1.75.

2. An image forming apparatus comprising:

a photoconductive drum to be formed with a latent image;

a developing roller to rotate together with the photoconductive drum with a developing gap therebetween and to transfer a developer which is a mixture of a toner and a carrier to the photoconductive drum to form a toner image on the latent image; and a blade mounted at a predetermined distance from the developing roller to cut the developer transferred to the developing roller by a predetermined thickness and to form a second gap between the blade and the developing roller.

wherein a linear velocity ratio of a linear velocity of the developing roller to a linear velocity of the photoconductive drum is 1.70 to 1.75, wherein the developing gap is smaller than the second gap between the blade and the developing roller, and wherein the second gap between the blade and the developing roller is 0.75 mm to 0.80 mm.

3. The image forming apparatus of claim 2, wherein the developing gap is 0.73 mm to 0.76 mm.

4. The image forming apparatus of claim 2, further comprising:

a mixer to mix the toner and the carrier into the developer.

5. The image forming apparatus of claim 3, further comprising:

a mixer to mix the toner and the carrier into the developer, wherein the second gap between the blade and the developing roller is 0.75 mm to 0.80 mm.

6. The image forming apparatus of claim 2, wherein a diameter of the photoconductive drum is not more than 30 mm, and a diameter of the developing roller is not more than 25 mm.

7. The image forming apparatus of claim 3, wherein a diameter of the photoconductive drum is not more than 30 mm, and a diameter of the developing roller is not more than 25 mm.

8. The image forming apparatus of claim 2, wherein the photoconductive drum and the developing roller rotate in an opposite direction to each other.

9. The image forming apparatus of claim 3, wherein the photoconductive drum and the developing roller rotate in an opposite direction to each other.

10. The image forming apparatus of claim 2, wherein the toner comprises non-magnetic toner particles, and the carrier comprises magnetic carrier particles.

11. The image forming apparatus of claim 2, wherein the toner and the carrier have opposite potentials.

12. The image forming apparatus of claim 2, wherein an outer diameter of the photoconductive drum is about 30 mm, an outer diameter of the developing roller is about 24 mm, and the developing gap is between about 0.73 mm and 0.76 mm inclusive.

13. The image forming apparatus of claim 2, wherein the developer has a 5% to 8% mixing ratio of the toner with respect to the carrier.

14. An image forming apparatus comprising:

a photoconductive drum to rotate at a first linear velocity;

a developing roller spaced apart from the photoconductive drum by a developing gap to rotate at a second linear velocity to develop an electrostatic latent image formed on the photoconductive drum using a developer; and a blade spaced apart from the developing roller by a second gap to control a thickness of the developer adhering to the developing roller, wherein a ratio of the second linear velocity with respect to the first linear velocity is between 1.70 and 1.75 inclusive, wherein the developing gap is smaller than the second gap between the blade and the developing roller, and wherein the second gap between the blade and the developing roller is 0.75 mm to 0.80 mm.

15. The image forming apparatus of claim 14, wherein the developing gap is between 0.73 mm and 0.76 mm inclusive.

16. The image forming apparatus of claim 14, wherein the developing gap is slightly smaller than the second gap.

17. The image forming apparatus of claim 14, wherein the photoconductive drum has a diameter smaller than 30 mm, and the developing roller has a diameter smaller than the diameter of the photoconductive drum.

18. The image forming apparatus of claim 14, wherein the developing roller has a diameter smaller than 25 mm, and the photoconductive drum has a diameter larger than the diameter of the developing roller.

19. The image forming apparatus of claim 14, wherein the developing roller and the photoconductive drum rotate with the ratio in opposite directions to prevent density deterioration and brush mark appearance.

20. The image forming apparatus of claim 14, wherein the developer comprises toner particles and carrier particles, and a ratio of the toner particles with respect to the carrier particles is between 5% and 8% inclusive.

21. A method of an image forming apparatus, the method comprising:

rotating a photoconductive drum at a first linear velocity; and rotating a developing roller spaced apart from the photoconductive drum by a developing gap at a second linear velocity to develop an electrostatic latent image formed on the photoconductive drum using a developer, and controlling a thickness of the developer adhering to the developing roller using a blade spaced apart from the developing roller by a second gap, wherein a ratio of the second linear velocity with respect to the first linear velocity is between 1.70 and 1.75 inclusive, and wherein the developing gap is smaller than the second gap between the blade and the developing roller.

22. The method of claim 21, wherein the developer comprises toner particles and carrier particles, and a ratio of the toner particles with respect to the carrier particles is between 5% and 8% inclusive.

* * * * *